US006923739B2

(12) United States Patent
Gait et al.

(10) Patent No.: US 6,923,739 B2
(45) Date of Patent: Aug. 2, 2005

(54) LACROSSE HEAD WITH EDGE PROTRUSIONS

(75) Inventors: Gary C. Gait, Lutherville, MD (US); Dale W. Kohler, Hunt Valley, MD (US)

(73) Assignee: STX, LLC, Baltimore, MD (US)

( * ) Notice: Subject to any disclaimer, the term of this patent is extended or adjusted under 35 U.S.C. 154(b) by 0 days.

(21) Appl. No.: 10/609,480

(22) Filed: Jul. 1, 2003

(65) Prior Publication Data

US 2004/0053714 A1 Mar. 18, 2004

Related U.S. Application Data

(60) Provisional application No. 60/392,932, filed on Jul. 2, 2002.

(51) Int. Cl.[7] ..... A63B 59/02; A63B 65/12

(52) U.S. Cl. ..... 473/513; D21/724

(58) Field of Search ..... 473/513, 512, 473/514, 528, 543, 505; D21/724

(56) References Cited

U.S. PATENT DOCUMENTS 3,507,495 A 4/1970 Tucker et al.
4,034,984 A 7/1977 Crawford et al.
5,080,372 A * 1/1992 Brine et al. ..... 473/513
5,566,947 A 10/1996 Tucker et al.
5,651,549 A * 7/1997 Dill et al. ..... 473/513
5,935,026 A * 8/1999 Dill et al. ..... 473/513
6,066,056 A * 5/2000 Morrow ..... 473/513
6,561,932 B2 * 5/2003 Morrow et al. ..... 473/513
6,723,134 B2 * 4/2004 Tucker, Sr. ..... 473/513

* cited by examiner

*Primary Examiner*—Gregory Vidovich
*Assistant Examiner*—M. Chambers
(74) *Attorney, Agent, or Firm*—Pillsbury Winthrop Shaw Pittman LLP

(57) ABSTRACT

A lacrosse head having protrusions on its top and/or bottom edges, which improve ball control. Preferably, the protrusions on the top edge protrude toward the interior of the lacrosse head and the protrusions on the bottom edge protrude away from the interior of the lacrosse head. In a further embodiment, the lacrosse head has a top protrusion disposed on the top edge of a sidewall, and a bottom protrusion on disposed on the bottom edge of the sidewall, such that any height of the lacrosse head frame, inclusive of the top protrusion and the bottom protrusion, does not exceed a specified sidewall height, even though the sum of the height of the sidewall, the height of the top protrusion, and the height of the bottom protrusion, measured separately and nonlinearly, exceed the specified sidewall height.

21 Claims, 8 Drawing Sheets

LACROSSE HEAD WITH EDGE PROTRUSIONS

This application claims the benefit of U.S. Provisional Application No. 60/392,932, filed Jul. 2, 2002, which is herein incorporated by reference in its entirety.

BACKGROUND

1. Field of the Invention

The present invention relates generally to lacrosse sticks, and more particularly, to a lacrosse head having protrusions on its top and/or bottom edges, which improve ball control.

2. Background of the Invention

FIG. 1 illustrates a conventional lacrosse stick 100 having a handle 102 shown in dotted lines, and a double-wall synthetic head 104. Head 104 comprises a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. As used herein, the area enclosed by the frame of head 104 (i.e., sidewalls 108 and 110, transverse wall 112, and stop member 114) is referred to as the interior of head 104.

As shown in FIG. 1, handle 102 fits into and through juncture 106, and abuts stop member 114. A screw or other fastener placed through opening 107 secures handle 102 to head 104.

For traditionally-strung pockets (which have thongs and string instead of mesh), thongs (not shown) made of leather or synthetic material extend from upper thong holes 116 in transverse wall 112 to lower thong holes 118 in stop member 114. In some designs, such as the design shown in FIG. 1, upper thong holes 116 are located on tabs 117 of the scoop 112. On other designs, upper thong holes 116 are located directly on the scoop 112. FIG. 1 shows four pairs (116, 118) of thong holes that accept four thongs. To complete the pocket web, the thongs have nylon strings threaded around the thongs and string laced through string holes 120 in sidewalls 108 and 110, forming any number of diamonds (crosslacing). Finally, one or more throwing or shooting strings extend transversely between the upper portions of sidewalls 108 and 110, attaching to throwing string holes 124 and a string laced through string holes 122. The typical features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Of particular relevance to the present invention are rules relating to the height of the sidewalls of the head. In a lacrosse game, these dimensional requirements prevent a player from using a stick that unfairly protects the lacrosse ball within a deeper pocket, such that it is more difficult for opponents to check the ball free. For this reason, men's rules permit a pocket depth of up to 2½ inches, below a sidewall that is up to 2 inches high. According to the traditional test, when looking horizontally at the sidewall of the men's lacrosse stick with a regulation ball inside the pocket, the sidewall must obstruct the view of at least a portion of the ball. (The total height of the sidewall and pocket must not exceed 4½ inches.) Similarly, women's rules limit the height of the sidewall to 1.8 inches (1⅘ inches or 4.5 cm) at the point of its greatest height, such that the top of a regulation ball placed inside the pocket can be always be seen over the sidewall when looking horizontally at the sidewall.

Referring again to FIG. 1, sidewalls 108 and 110 have an inside face, an outside face generally opposite the inside face, a bottom edge, and a top edge generally opposite the bottom edge. The inside face generally faces the interior of the head 104 (i.e., toward the pocket). The bottom edge is on the side of the head 104 on which the pocket is disposed. Similarly, stop member 114 has an inside face, a bottom edge, and a top edge generally opposite the bottom edge. The inside face of stop member 114 generally faces the interior of the head 104 (i.e., toward the pocket). The bottom edge of stop member 114 is on the side of the head 104 on which the pocket is disposed.

Traditionally, the inside face of a conventional sidewall or stop member is substantially perpendicular to the plane of the front face of head 104. This geometry allows a ball to freely roll over a sidewall or stop member without obstruction, from the back of the pocket to the front face of head 104. Players would prefer, however, means to limit the free travel of the ball over the sidewall and stop member, to better retain the ball within the pocket and maximize ball control.

U.S. Pat. No. 6,066,056 to Morrow attempts to meet these needs with a lacrosse head having ball retaining ridges that extend along the interior surface of the sidewalls and serve to direct and retain the ball within the pocket. Unfortunately, the placement of these ridges on the interior surface of the sidewalls limits the ball control advantages it provides for the entire height of the sidewall, especially with respect to pocket swing and the geometry by which the ball is rebounded into the pocket. In addition, the placement of the ridges on the interior surface of the sidewalls adds undesirable weight to the head. Finally, Morrow does not provide any specific ball control improvements relative to the stop member.

Thus, there remains a need for a lacrosse head that improves ball control over the stop member and the entire height of the sidewall. Furthermore, there is a need for a lacrosse head that provides these improvements without adding substantial weight and with an eye toward compliance with rules limiting sidewall height.

SUMMARY OF THE INVENTION

The present invention is a lacrosse head having a plurality of protrusions extending from one or both of its top and bottom edges. Protrusions on the top edge of the head are referred to herein as teeth, and are preferably located on the top edge of one or both sidewalls of the head. Protrusions on the bottom edge of the head are referred to herein as tabs, and are preferably located on the bottom edge of one or both sidewalls of the head and/or the bottom edge of the stop member of the head.

In an embodiment of the present invention, teeth protrude from the top edge of a sidewall in a direction toward the interior area of the lacrosse head frame. In this manner, when a ball inside the pocket contacts the top edge of the sidewall, the protruding structure of the teeth tends to rebound the ball back inside the lacrosse head frame. In contrast to a conventional sidewall, which allows a ball to freely travel over the sidewall, the teeth provide a rebound into the pocket that is especially helpful when a ball rattles in the pocket, for example, as a result of a stick check. As the ball rattles between the sidewalls, the protruding teeth help keep the ball within the pocket. In addition, having the teeth on the sidewall edge provides a favorable geometry in rebounding the ball from the front face of the head back toward the interior area of the lacrosse head. Thus, the teeth afford greater control of the ball, by directing the movement of the ball toward the pocket.

In another embodiment, the present invention provides tabs on the bottom edge of a sidewall and/or stop member. The tabs protrude in a direction away from the interior area of the lacrosse head frame. In this manner, when a ball inside the pocket contacts the bottom edge of the sidewall and/or stop member, the protruding structure of the tabs tends to catch and hold the ball within the pocket. Further enhancing this effect, as the pocket swings away from the center of the lacrosse head, the ball moves farther under the tabs, which effectively wedges the ball in the pocket. During cradling, this wedge effect occurs each time the ball swings from sidewall to sidewall, making it difficult to dislodge the ball from the pocket. Thus, the tabs afford better protection of the ball, by providing a surface against which to hold the ball in the pocket. Optionally, the tabs can include threading holes through which pocket threading can be strung.

Another embodiment of the present invention provides a lacrosse head frame having alternating top edge and bottom edge sidewall protrusions that ensure that the lacrosse head frame complies with rules limiting the overall height of the sidewall. In other words, when looking at the outside face of a sidewall with the lacrosse head in a horizontal position, the protrusions are disposed along the top and bottom edges of the sidewall such that the measured height of the lacrosse head, inclusive of the protrusions, does not exceed a maximum specified height (e.g., 2 inches under the men's rules). Typically, this height would be measured along a line substantially perpendicular to the top edge of the sidewall or to the axis of the shaft attached to the lacrosse head frame. Notably, by alternating the top and bottom protrusions, the sum of the height of the top protrusion, the height of the bottom protrusion, and the height of the sidewall, measured separately and nonlinearly, can exceed the specified maximum specified height—yet, the overall sidewall height, as typically measured for compliance, does not exceed the specified maximum height. In a specific implementation of the present invention, four teeth on the top edge of a sidewall alternate with five tabs on the bottom edge of the sidewall.

DETAILED DESCRIPTION OF THE INVENTION

Figure 1:
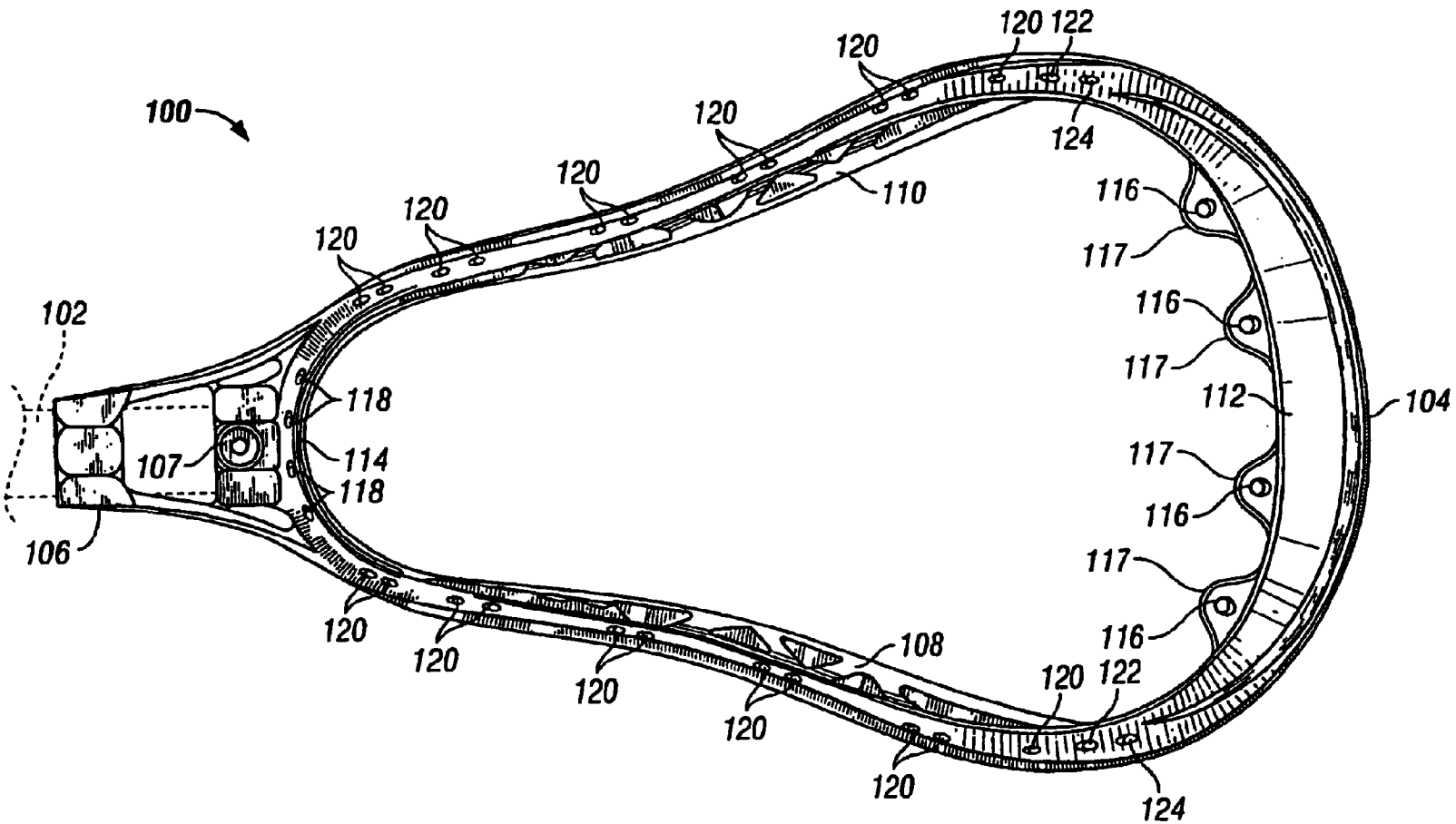
FIG. 1 (Prior Art)
FIG. 1 is a schematic diagram of a lacrosse stick.
Figure 2A:
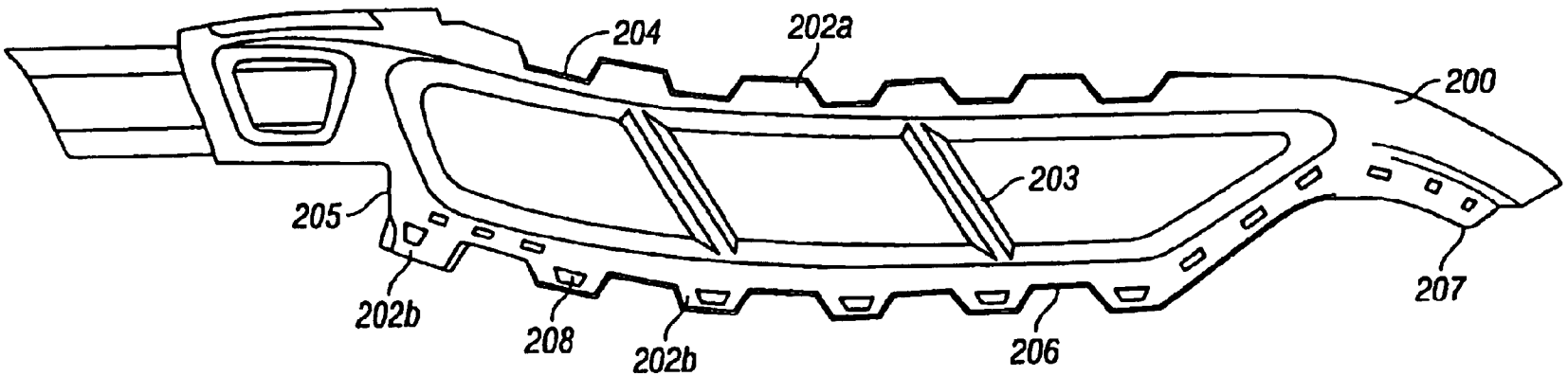
FIG. 2A is a schematic diagram of a side view of an exemplary lacrosse head, shown with surface shading, according to an embodiment of the present invention.
Figure 2B:
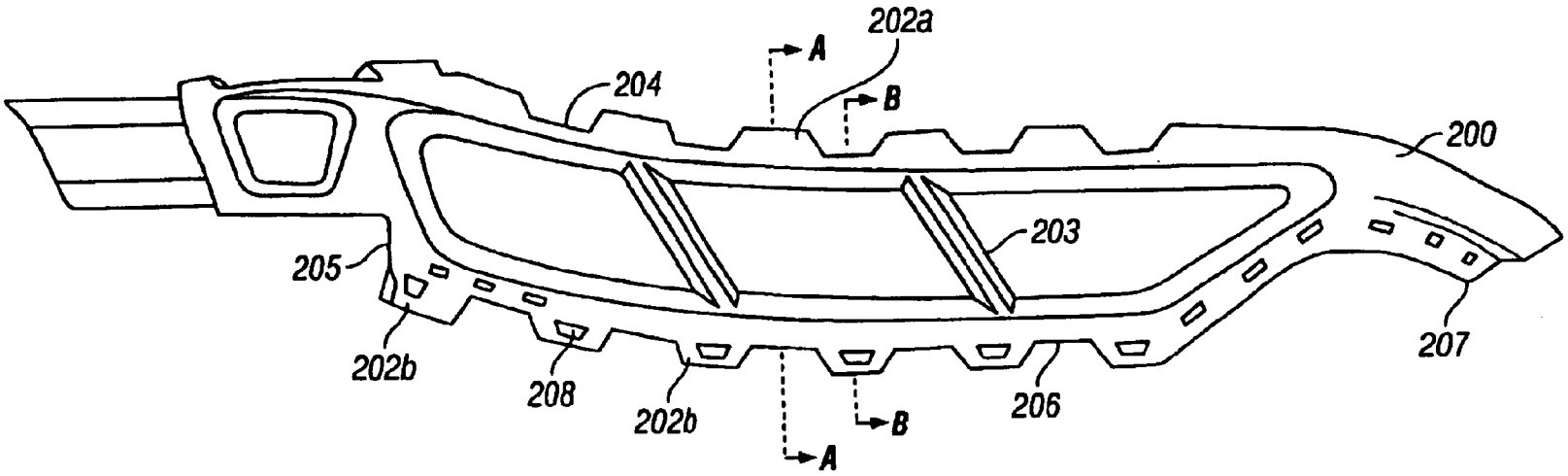
FIG. 2B is a schematic diagram of the lacrosse stick of FIG. 2A, without shading, and showing cross-section lines A and B.

According to an embodiment, FIGS. 2A and 2B illustrate an exemplary lacrosse head 200 having protrusions 202 on the edges of its sidewall 203 and stop member 205. The protrusions 202*a* on the top edge 204 of sidewall 203 are referred to herein as teeth. The protrusions 202*b* on the bottom edge 206 of sidewall 203 and the bottom edge of stop member 205 are referred to herein as tabs. Optionally, as shown in this example, the tabs 202*b* have openings 208 to which pocket threads (not shown) can be attached.

Figure 2D:
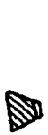
FIG. 2D is a schematic diagram of a cross-sectional view of the lacrosse head of FIG. 2B along line B.
Figure 2C:
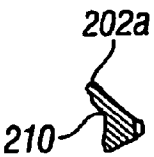
FIG. 2C is a schematic diagram of a cross-sectional view of the lacrosse head of FIG. 2B along line A.
Figure 2C:
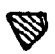

FIG. 2C illustrates a tooth 202*a* in more detail. As shown, tooth 202*a* protrudes toward the interior of lacrosse head 200. In this configuration, the inside face 210 of tooth 202*a* rebounds the ball back toward the pocket of head 200, enhancing a player's ability to keep a ball in the pocket. Although a particular shape, angle, and length of tooth 202*a* is shown in FIGS. 2A, 2B, and 2C, one of ordinary skill in the art would appreciate that these characteristics could vary to satisfy different performance characteristics.

FIG. 2D illustrates a tab 202*b* in more detail, including the thread opening 208 of the tab 202*b*. As shown, tab 202*b* protrudes away from the interior of lacrosse head 200. In this configuration, the inside face 212 of tab 202*b* holds a ball inside the pocket of head 200. Although a particular shape, angle, and length of tab 202*b* is shown in FIGS. 2A, 2B, and 2D, one of ordinary skill in the art would appreciate that these characteristics could vary to satisfy different performance characteristics. In addition, although FIGS. 2A, 2B, and 2D show tabs 202*b* only on sidewall 203 and stop member 205, similar tabs 202*b* could be disposed on scoop 207.

FIGS. 2A and 2B also demonstrate a series of teeth that alternates with a series of tabs. The series of teeth include spaces between adjacent teeth. Likewise, the series of tabs include spaces between adjacent tabs. The teeth 202*a* and tabs 202*b* alternate such that any measurement of the sidewall height, inclusive of the teeth 202*a* and tabs 202*b*, does not exceed a specified maximum sidewall height (e.g., 2 inches in the men's game). In this exemplary alternating arrangement, generally, no tab 202*b* on the bottom edge 206 of sidewall 203 is positioned below a tooth 202*a* on the top edge 204. In other words, referring to FIG. 2B, no two protrusions 202 are generally located along a vertical line drawn approximately perpendicular to the top edge 204 and/or bottom edge 206 (or the axis of the shaft), such as lines A and B. In this way, the maximum height that could be included in measuring the height of sidewall 203 would include only one protrusion 202, and not two protrusions 202. This alternating configuration enables the present invention to provide the performance benefits associated with teeth 202*a* and tabs 202*b*, while still complying with any applicable rules limiting the height of a sidewall (e.g., the current women's rule limiting the sidewall height to 1.8 inches and the current men's rule limiting the sidewall height to 2 inches).

As one of ordinary skill in the art would appreciate, and as shown in FIG. 2B, the alternating teeth 202*a* and tabs 202*b* can overlap to a certain extent and still comply with the maximum specified sidewall height. For example, a tab and a tooth can overlap in an area in which one is decreasing in height and the other is increasing in height at approximately the same rates. In this way, their combined height remains roughly the same. In FIG. 2B, in the area between lines A and B, the overlapping tapered corners of tabs 202*a* and teeth 202*b* exemplify this configuration.

Figure 3A:
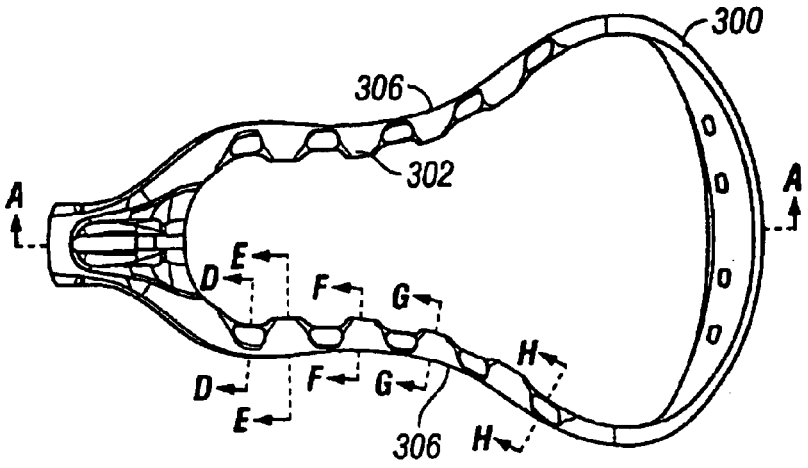
FIG. 3A is a schematic diagram of a top view of an exemplary lacrosse head, according to an embodiment of the present invention.
Figure 3B:
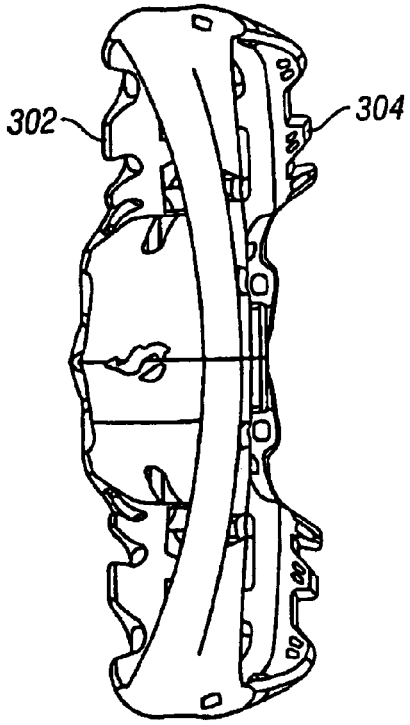
FIG. 3B is a schematic diagram of a side view of the lacrosse head of FIG. 3A, facing the scoop of the lacrosse head.
Figure 3C:
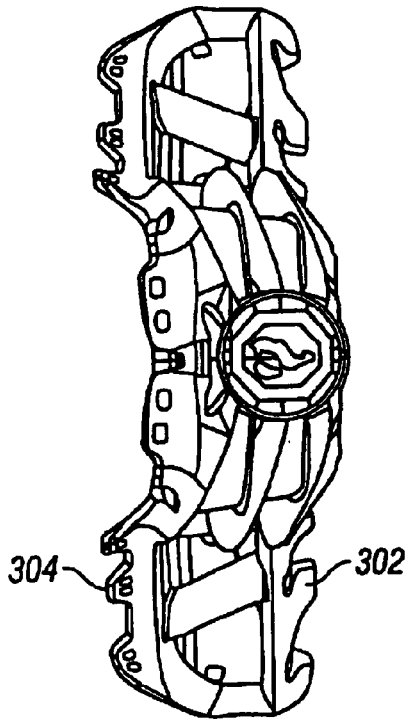
FIG. 3C is a schematic diagram of a side view of the lacrosse head of FIG. 3A, facing the juncture of the lacrosse head.
Figure 3D:
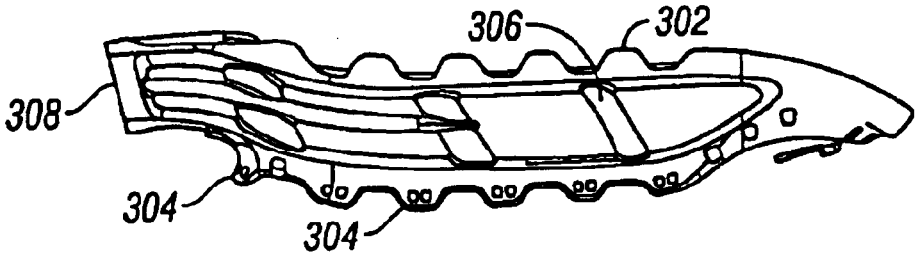
FIG. 3D is a schematic diagram of a side view of the lacrosse head of FIG. 3A, facing the outside face of a sidewall of the lacrosse head.
Figure 3E:
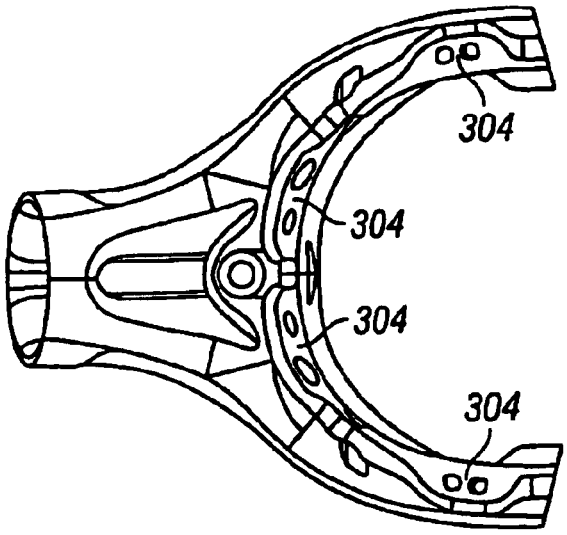
FIG. 3E is a schematic diagram of a partial bottom view of the lacrosse head of FIG. 3A.

FIGS. 3A–3E illustrate another exemplary lacrosse head 300 having teeth 302 and tabs 304, according to an embodiment of the present invention. As shown best in FIGS. 3B and 3C, teeth 302 protrude inward toward the interior of lacrosse head 300, while tabs 304 flare outward away from the interior of lacrosse head 300. FIG. 3D shows the alternating placement of each of the teeth 302 and tabs 304, such that any measurement of the sidewall height, inclusive of the teeth 302 and tabs 304, does not exceed a specified maximum sidewall height, even though the sum of the height of the sidewall 306, the height of a tooth 302, and the height of the tab 304, measured separately and nonlinearly, exceed the specified maximum sidewall height. As shown in the alternating configuration, generally no tooth 302 is disposed over a tab 304. The sidewall height would be measured on a line drawn across the height of sidewall 306 roughly perpendicular to the axis of the juncture 308 that receives the lacrosse stick shaft.

Figure 4:
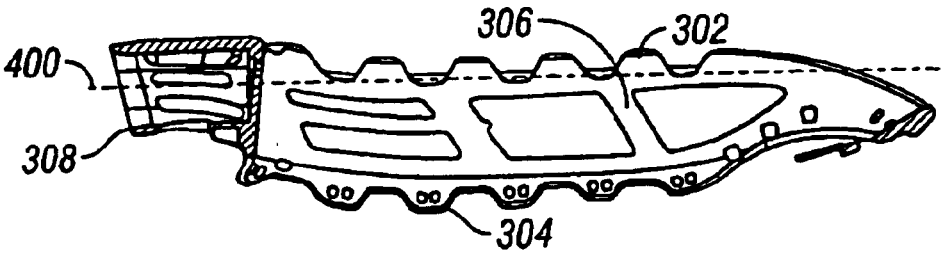
FIG. 4 is a schematic diagram of a cross-section of the lacrosse head of FIG. 3A along line A—A.

FIG. 4 illustrates a cross-sectional view of the lacrosse head 300 of FIG. 3A along line A—A. This cross-sectional view shows the axis 400 of juncture 308 and the inside face of a sidewall 306 of lacrosse head 300, including inside views of teeth 302 and tabs 304.

Figure 5:
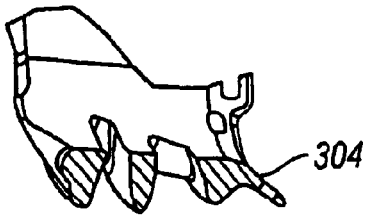
FIG. 5 is a schematic diagram of a cross-section of the lacrosse head of FIG. 3A along line D—D.

FIG. 5 illustrates a cross-sectional view of the lacrosse head 300 of FIG. 3A along line D—D. This view shows an example of how a tab 304 can flare away from the interior of head 300.

Figure 6:
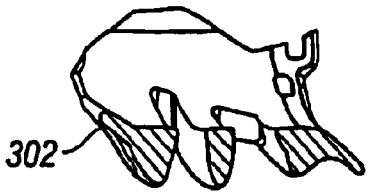
FIG. 6 is a schematic diagram of a cross-section of the lacrosse head of FIG. 3A along line E—E.

FIG. 6 illustrates a cross-sectional view of the lacrosse head 300 of FIG. 3A along line E—E. This view shows an example of how a tooth 302 can protrude toward the interior of head 300.

Figure 7:
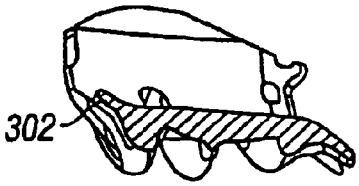
FIG. 7 is a schematic diagram of a cross-section of the lacrosse head of FIG. 3A along line F—F.

FIG. 7 illustrates a cross-sectional view of the lacrosse head 300 of FIG. 3A along line F—F. This view shows another example of how a tooth 302 can protrude toward the interior of head 300.

Figure 8:
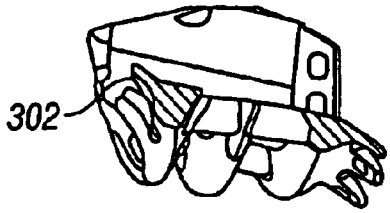
FIG. 8 is a schematic diagram of a cross-section of the lacrosse head of FIG. 3A along line G—G.

FIG. 8 illustrates a cross-sectional view of the lacrosse head 300 of FIG. 3A along line F—F. This view shows another example of how a tooth 302 can protrude toward the interior of head 300.

Figure 9:
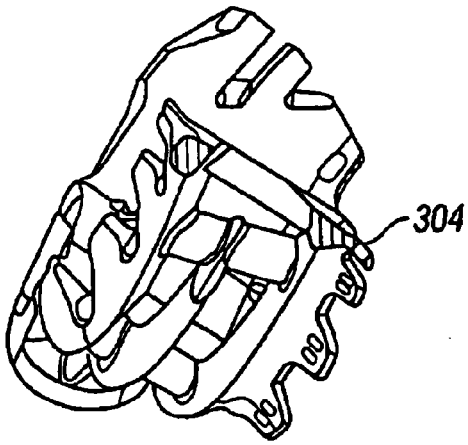
FIG. 9 is a schematic diagram of a cross-section of the lacrosse head of FIG. 3A along line H—H.

FIG. 9 illustrates a cross-sectional view of the lacrosse head 300 of FIG. 3A along line H—H. This view shows another example of how a tab 304 can flare away from the interior of head 300.

Figure 10:
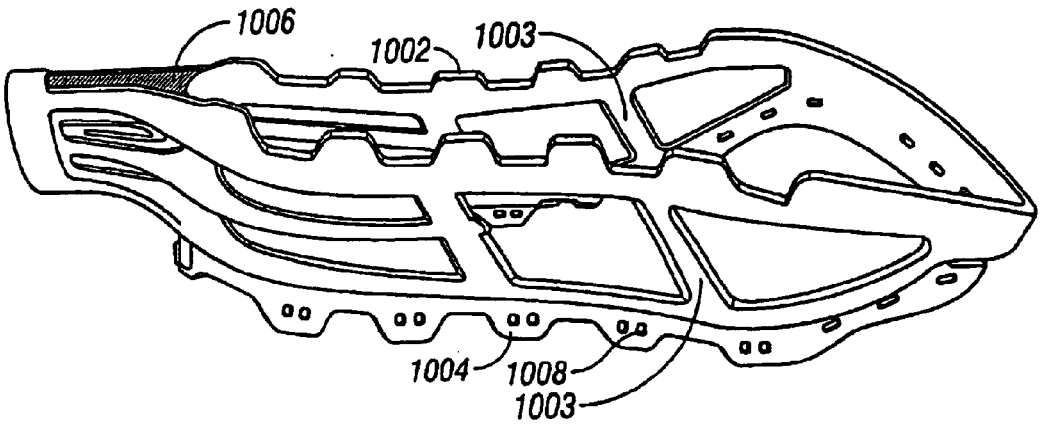
FIG. 10 is an image of an isometric view of an exemplary lacrosse head, facing the outside face of a sidewall of the lacrosse head, according to an embodiment of the present invention.
Figure 11:
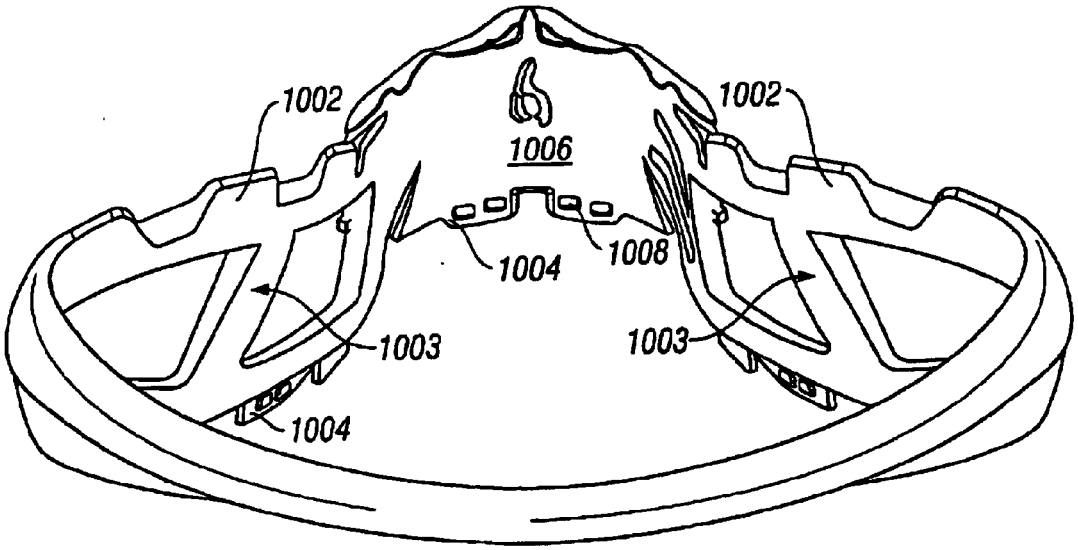
FIG. 11 is an image of an isometric view of an exemplary lacrosse head, facing the scoop of the lacrosse head and looking down on the top edge of the sidewalls, according to an embodiment of the present invention.
Figure 12:
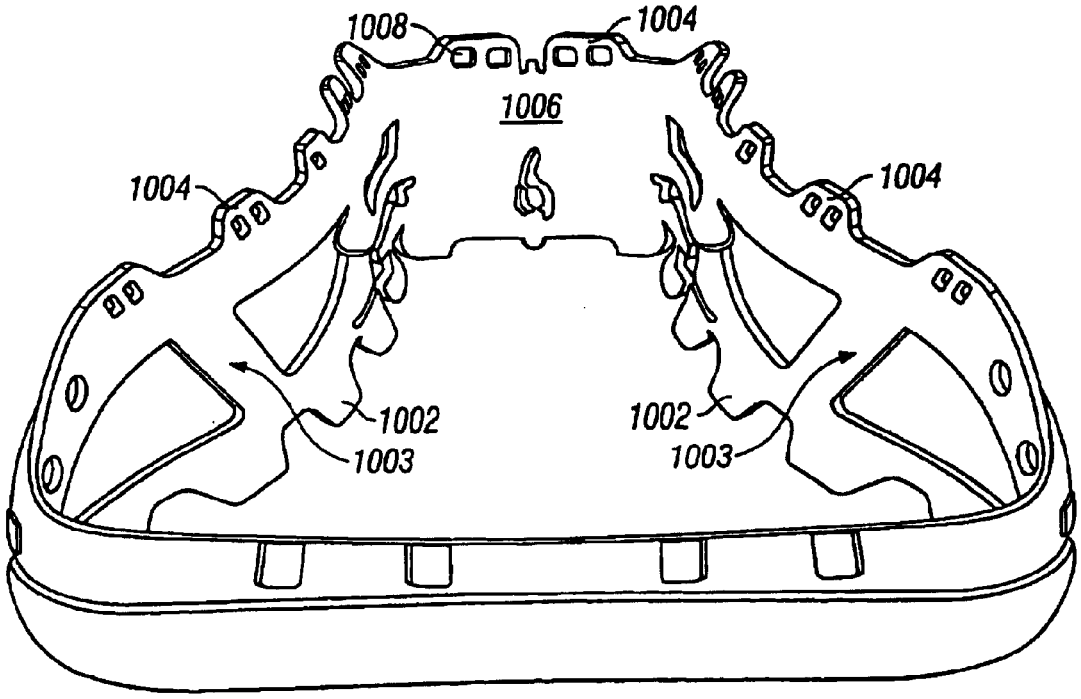
FIG. 12 is an image of an isometric view of an exemplary lacrosse head, facing the scoop of the lacrosse head and looking down on the bottom edge of the sidewalls, according to an embodiment of the present invention.

FIGS. 10, 11, and 12 illustrate an exemplary implementation of the present invention. As shown, this implementation includes teeth 1002 that curve toward the interior of the lacrosse head 1000 and tabs 1004 that flare out away from the interior of the lacrosse head 1000. The teeth 1002 are disposed on the top edge of the sidewalls 1003. The tabs 1004 are located on the bottom edge of the sidewalls 1003 and the stop member 1006. The tabs 1004 include openings 1008 through which pocket threads can be strung.

Figure 13:
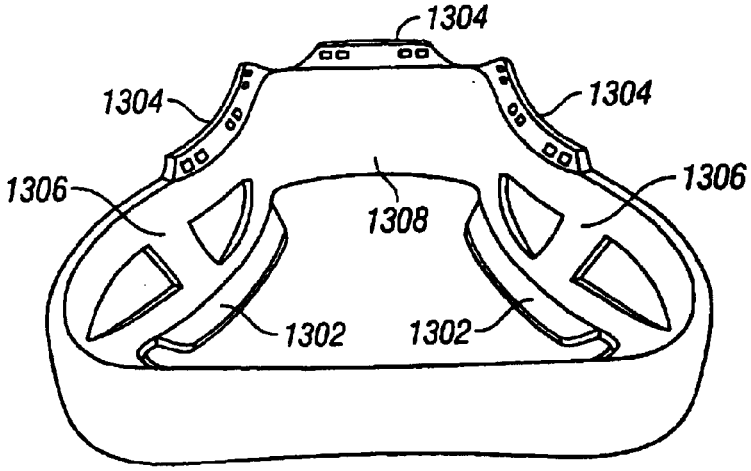
FIG. 13 is a schematic diagram of isometric view of an exemplary lacrosse head having continuous sidewall edge protrusions facing the scoop and looking down on the bottom edge of the sidewalls.

As an alternative to the embodiments above, which illustrate a plurality of individual protrusions that are spaced apart on the edge of a sidewall, another embodiment provides a single continuous protrusion along an edge of a sidewall, examples of which are shown in FIG. 13. FIG. 13 illustrates a lacrosse head positioned face down, looking down on the bottom edge of the sidewalls. In this example, one continuous tooth 1302 is disposed on the top edge of a sidewall 1306. Similarly, one continuous tab 1304 is disposed on the bottom edge of a sidewall 1306 or stop member 1308. Like a series of individual protrusions along an edge of a sidewall, a single continuous protrusion would also protrude toward the interior of the head (in the case of a protrusion on the top edge of a sidewall) or away from the interior of the head (in the case of a protrusion on the bottom edge of a sidewall). A single continuous protrusion could, of course, also be disposed on edges of the scoop, as appropriate.

In contrast to a continuous protrusion, however, having one or more individual protrusions along the edge of a sidewall reduces the overall weight of the lacrosse head, while still providing the above-mentioned ball control and ball retention benefits. As long as the spaces between the protrusions are small enough in relation to the curve of the outside face of the ball such that the ball cannot pass between protrusions without contacting the protrusions, the individual protrusions are preferable to minimize the weight of the head. Moreover, when protrusions are applied to both the top and bottom edges of a sidewall, having staggered, alternating individual protrusions enables a lacrosse head frame to comply with dimensional rules governing the maximum height of a sidewall, as described above.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. The scope of the invention is to be defined only by the claims, and by their equivalents.

What is claimed is:

1. A lacrosse head comprising:

a frame having a top edge, a bottom edge, an interior face, and an exterior face, wherein the frame encloses an interior area, and wherein the frame is adapted to receive a pocket disposed adjacent to the bottom edge; and a plurality of top protrusions disposed on the top edge; and a plurality of bottom protrusions disposed on the bottom edge arranged such that the bottom protrusions are substantially alternating with respect to the top protrusions, wherein the frame is adapted to receive a shaft along a shaft axis, and wherein the protrusions on the top and bottom edges of the frame are disposed along the frame such that heights of the frame measured on a line substantially perpendicularly to the shaft axis, inclusive of any top protrusion and bottom protrusion along the line, are substantially constant.

2. The lacrosse head of claim 1, wherein the frame comprises a stop member, two sidewalls connected to the stop member, and a scoop connected to the two sidewalls opposite the stop member, and wherein at least one of the top protrusions and at least one of the bottom protrusions is disposed on at least one of the two sidewalls.

3. The lacrosse head of claim 1, wherein the heights of the frame do not exceed approximately 2 inches.

4. The lacrosse head of claim 1, wherein the heights of the frame do not exceed approximately 1.8 inches.

5. The lacrosse head of claim 1, wherein at least one of the bottom protrusions is disposed substantially in a location on the bottom edge corresponding to a space formed on the top edge between two adjacent top protrusions.

6. The lacrosse head of claim 2, wherein the sum of the height of a sidewall, the height of at least one top protrusion on the sidewall and the height of the at least one bottom protrusion on the sidewall measured separately, exceeds one of approximately 2 inches and approximately 1.8 inches.

7. The lacrosse head of claim 1, wherein at least one bottom protrusion protrudes away from the interior area.

8. The lacrosse head of claim 7, wherein at least one top protrusion and the at least one bottom protrusion are disposed along the frame such that any frame height, inclusive of the at least one top protrusion and the at least one bottom protrusion and measured substantially perpendicularly to the top edge, does not exceed a specified height of one of approximately 2 inches and approximately 1.8 inches, and wherein the sum of the height of a sidewall of the frame, the height of the at least one top protrusion, and the height of the at least one bottom protrusion, measured separately, exceeds the specified height.

9. The lacrosse head of claim 7, wherein at least one top protrusion and the at least one bottom protrusion are disposed along the frame such that any frame height, inclusive of the at least one top protrusion and the at least one bottom protrusion and measured substantially perpendicularly to the shaft axis, does not exceed a specified height of one of approximately 2 inches and approximately 1.8 inches, and wherein the sum of the height of a sidewall of the frame, the height of the at least one top protrusion, and the height of the at least one bottom protrusion, measured separately, exceeds the specified height.

10. The lacrosse head of claim 7, wherein the at least one bottom protrusion defines thread openings.

11. The lacrosse head of claim 1, wherein at least one of the plurality of bottom protrusions has an opening to which the pocket can be strung.

12. A lacrosse head comprising:

a stop member;

sidewalls extending from the stop member, wherein the sidewalls have a top edge, a bottom edge, an interior face, and an exterior face;

a transverse wall joining the sidewalls at their end opposite to the stop member, wherein an interior area is defined by the stop member, the sidewalls, and the transverse wall; and a plurality of top protrusions disposed on the top edge; and a plurality of bottom protrusions disposed on the bottom edge arranged such that the bottom protrusions are substantially alternating with respect to the top protrusions, wherein the lacrosse head is adapted to receive a shaft along a shaft axis, and wherein the top protrusions and the bottom protrusions are disposed along the sidewall such that heights of the sidewalls measured on a line substantially perpendicularly to the shaft axis, inclusive of any top protrusion and bottom protrusion along the line, are substantially constant.

13. The lacrosse head of claim 12, wherein the stop member has an upper edge, a lower edge, and an inside face, and wherein the lacrosse head further comprises a tab disposed on the lower edge of the stop member, wherein the tab protrudes away from the interior area.

14. The lacrosse head of claim 12, wherein at least one of the top protrusions protrudes toward the interior area, and wherein one of the bottom protrusions is disposed substantially between two adjacent top protrusions.

15. The lacrosse head of claim 12, wherein the heights of the sidewalls are no greater than a specified sidewall height of one of approximately 2 inches and approximately 1.8 inches.

16. The lacrosse head of claim 15, wherein the sum of the height of a top protrusion, the height of a bottom protrusion, and the height of the sidewall, measured separately, exceeds the specified sidewall height.

17. A lacrosse head comprising:

a stop member;

sidewalls extending from the stop member, wherein the sidewalls have a top edge, a bottom edge, an interior face, and an exterior face;

a transverse wall joining the sidewalls at their end opposite to the stop member, wherein an interior area is defined by the stop member, the sidewalls, and the transverse wall;

a tooth disposed on the top edge of a sidewall of the sidewalls;

a tab disposed on the bottom edge of the sidewall, wherein the head is adapted to receive a shaft along a shaft axis, wherein the sum of the height of the tooth, the height of the tab, and the height of the sidewall, measured separately, exceeds a maximum sidewall height of one of approximately 2 inches and approximately 1.8 inches, and wherein the tooth and the tab are disposed along the sidewall such that any height of the lacrosse head measured substantially perpendicularly to the shaft axis, inclusive of the tooth and the tab, is no greater than the maximum sidewall height, wherein the tooth and the tab are disposed along the sidewall such that heights of the sidewall measured on line substantially perpendicularly to the shaft axis, inclusive of the tooth and the tab when they are along the line, are substantially constant.

18. The lacrosse head of claim 17, wherein the tooth protrudes toward the interior area.

19. The lacrosse head of claim 17, wherein the tab protrudes away from the interior area.

20. The lacrosse head of claim 17, wherein the tab defines thread openings.

21. The lacrosse head of claim 17, further comprising a second tooth disposed on the top edge of the sidewall and spaced apart from the tooth, and wherein the tab is disposed substantially between the tooth and the second tooth.

* * * * *